343-756
9/6/77 XR 4,047,128

United States Patent [19]

Morz

[11] 4,047,128

[45] Sept. 6, 1977

[54] SYSTEM FILTER FOR DOUBLE FREQUENCY UTILIZATION

[75] Inventor: Gunter Morz, Ludwigsburg, Germany

[73] Assignee: Licentia Patent-Verwaltungs-G.m.b.H., Frankfurt am Main, Germany

[21] Appl. No.: 678,387

[22] Filed: Apr. 19, 1976

[30] Foreign Application Priority Data

Apr. 19, 1975 Germany ..... 2517383

[51] Int. Cl.[2] ..... H01P 1/16; H01P 5/20

[52] U.S. Cl. ..... 333/11; 333/21 R; 333/21 A; 343/756; 343/786

[58] Field of Search ..... 333/6, 11, 21 R, 21 A, 333/73 W; 343/756, 786

[56] References Cited

U.S. PATENT DOCUMENTS

| | | | |
|---|---|---|---|
| 2,961,618 | 11/1960 | Ohm | 333/21 R X |
| 3,566,309 | 2/1971 | Ajioka | 333/21 R X |
| 3,731,236 | 5/1973 | DiTullio et al. | 333/21 A X |

*Primary Examiner*—Paul L. Gensler
*Attorney, Agent, or Firm*—Spencer & Kaye

[57] ABSTRACT

A system filter for double frequency utilization, including a broadband polarization filter in conjunction with frequency filters for separating two different frequency bands with each frequency band being doubly orthogonally polarized. The broadband polarization filter of singly symmetrical construction includes a doubly polarizable waveguide section which is axially divided by means of a partition into two symmetrical partial waveguides and the two frequency bands of the wave which is polarized parallel to the partition are each coupled out through a respective coupling window in two oppositely disposed walls of the waveguide section into a respective waveguide tee. The higher frequency band of the decoupled wave is available at the sum arm of a magic tee which has two symmetrical arms each connected via a respective highpass filter to a respective arm of one of the waveguide tees, while the lower frequency band is available at the sum arm of a further magic tee which has two symmetrical arms each connected via a respective bandpass filter to a respective arm of one of the waveguide tees. The orthogonally polarized wave is divided into the two further frequency bands in a further frequency filter which is connected in series with the doubly polarizable waveguide section via a transition piece.

14 Claims, 5 Drawing Figures

SYSTEM FILTER FOR DOUBLE FREQUENCY UTILIZATION

BACKGROUND OF THE INVENTION

The present invention relates to a system filter for double frequency utilization, including a broadband polarization filter in conjunction with frequency filters, for separating two different frequency bands where each frequency band is itself doubly orthogonally polarized.

The desire for a high number of channels in data transmission systems, particularly for transmission via satellites and in radio systems, requires optimum utilization of the instruments involved and of the antenna arrangements. For this purpose the use of polarized systems offers itself automatically since in this way two channels can be used at the same frequency. However, a prerequisite for this use is very high decoupling of the two polarized signals which then permits genuine double frequency utilization.

Since usually two frequency bands which are spaced relatively far apart are required for transmitting and receiving (e.g. 11 and 14 GHz bands), these antenna multiplex systems take on the function, in addition to separating the two polarizations, of being frequency filters. A combination of a polarization filter and a frequency filter is called a system filter.

German Pat. No. 1,128,491 discloses a classical polarization filter of the type utilizing a waveguide to whose outputs frequency filters can be connected. This filter is suitable only for small spacings between the frequency bands since the occurrence of higher waveguide modes constitutes an upper limit for its use under the above-mentioned conditions.

The Siemens advertising pamphlet No. S. 42024-04--A-2-29 "System filter 4/6 GHz" describes a filter arrangement with frequency selective 0 dB couplers. These filters are used, for example, to couple the two polarizations of the higher frequency band out of a square or circular waveguide by means of highpass directional couplers, while the polarization separation in the low frequency band is effected by means of a classical polarization filter. This filter is also suited for frequency bands which are spaced far apart (e.g. 4 and 6 GHz, 11 and 18 GHz) but it has the drawback that losses are relatively high and its external dimensions are rather large.

A doubly symmetrical polarization filter operating with four decouplers is disclosed in applicant's copending allowed U.S. Pat. application Ser. No. 611,974, filed Sept. 10, 1975, now U.S. Pat. No. 3,978,434, issued Aug. 31, 1976. This filter principle can be utilized, depending on the particular embodiment, for frequency bands which are spaced more or less far apart (e.g. 12/18 or 11/14 GHz). The drawback of this filter arrangement is, however, that electrical asymmetries in the four decoupling branches may lead to cross coupling of the polarizations.

SUMMARY OF THE INVENTION

It is therefore the object of the present invention to provide a system filter which has much better decoupling (at least 50dB) of the two polarizations and of the transmitting and receiving channels where electrical asymmetries do not hamper polarization decoupling and which has lower losses.

It is a further object to provide such a system filter wherein it is possible to provide a decoupler which can be connected to a tracking antenna device to correct the deviation of the axis of an antenna connected to the system filter from its nominal direction.

This is accomplished according to the preferred embodiment of the present invention in that the system filter comprises: a singly symmetrically constructed broadband polarization filter including a doubly polarizable waveguide section which is axially divided by a partitioning structure into symmetrical partial waveguides, and which is provided with two oppositely disposed coupling windows in the waveguide section walls so that each of the two frequency bands of the wave which is polarized parallel to the plane of the partitioning structure is decoupled into a branch line; a respective highpass filter, for passing the higher of the two frequency bands, and a respective bandpass filter, for passing the lower of the two frequency bands connected to each of the branch lines; a first magic tee having its two symmetrical arms connected to the respective outputs of the highpass filters so that the higher frequency band is available at the sum arm of the first magic tee; a second magic tee having its two symmetrical arms connected to the respective outputs of the bandpass filters so that the lower frequency band is available at the sum arm of the second magic tee; and, a further frequency filter, connected in series with the doubly polarizable waveguide via a transition piece, for dividing the other orthogonally polarized wave into the two further frequency bands.

Preferably each of the coupling windows in the oppositely disposed walls of the waveguide is provided with at least one longitudinal bar which extends parallel to the longer side of the rectangular waveguide coupled to the window. Additionally it is advisable to terminate the differential outputs of the T-junctions or magic tees by means of an absorber. The condition for termination of a tracking antenna device is met in that a coaxial cable or waveguide decoupler is disposed in the plane of the partitioning structure and is connected with a tracking antenna device which corrects the deviation of the axis of the antenna, which is connected to the system filter, from its nominal direction.

In order to separate the two frequency bands, it is advantageous to form the highpass filter of a waveguide with a cross section which is dimensioned so that the lower frequency band is unable to propagate, and whose reduced cross section is connected, via a continuous transition piece, with the T-junction or magic tee which has a standard cross section.

For these dimensions of the doubly polarizable waveguide section, it is advisable that its cross section permit the propagation of the fundamental mode as well as of the next higher modes and such doubly polarizable waveguide can have a square or circular cross section. If circular polarization is desired, it is advisable to connect a polarization converter ahead of the system filter to convert the orthogonally linearly polarized wave into an orthogonally circularly polarized wave.

With such a structure of the system filter for double frequency utilization, optimum decoupling of the two polarizations is realized, energy losses are avoided, and favorable matching conditions are produced.

Figure 1:
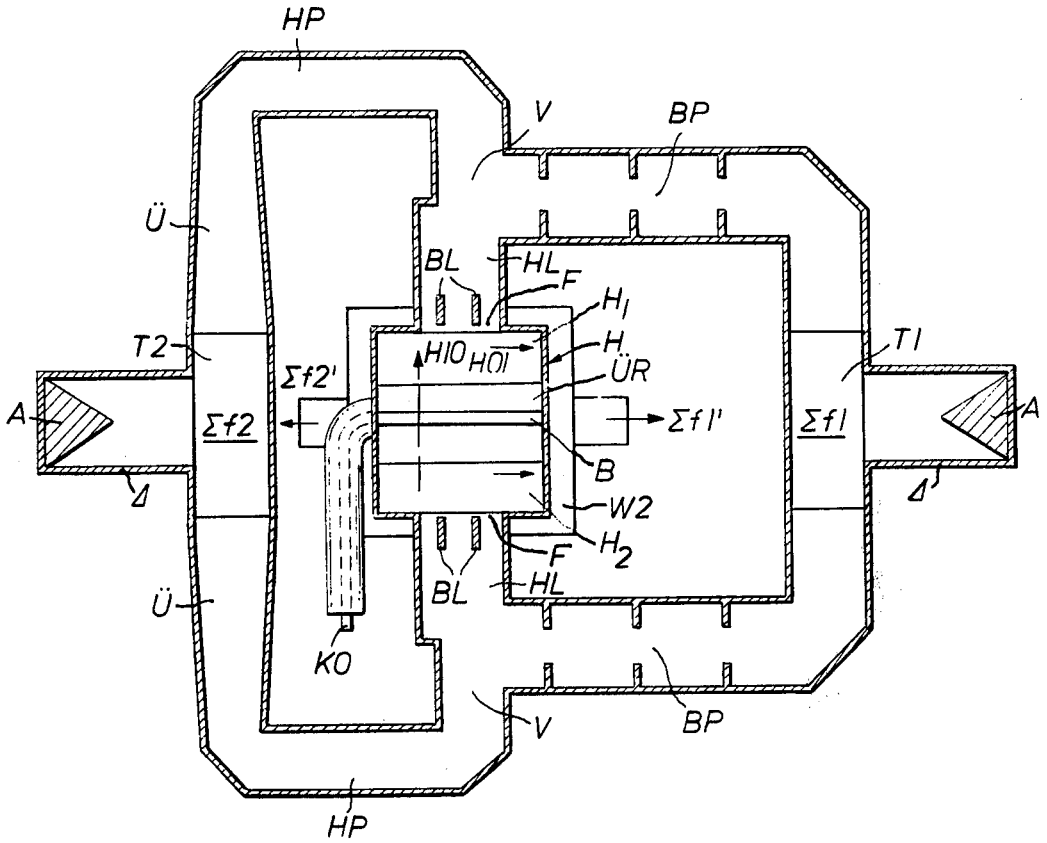
FIG. 1 is a schematic plan view of an embodiment according to the invention of a system filter for double frequency utilization.

FIG. *2a* is a detailed view of the central square waveguide H with the decoupling waveguides HL and the waveguide-transition ÜR of FIG. 1.

FIG. *2b* shows the variation of the $H_{10}$ and the $H_{11}$, $E_{11}$ waves with movement of the antenna in the *y-z* plane.

Figure 3:
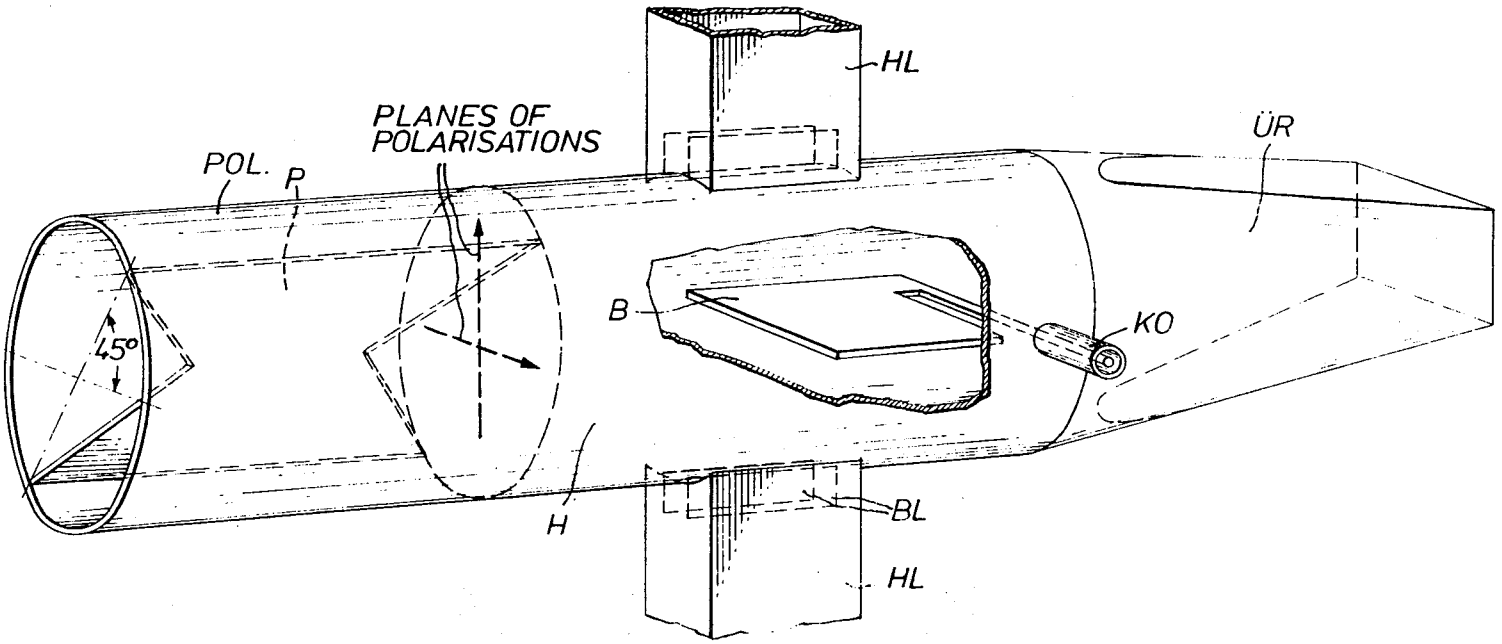

FIG. 3 shows the central part of the system filter using a doubly polarisable waveguide with circular cross-section.

Figure 4:
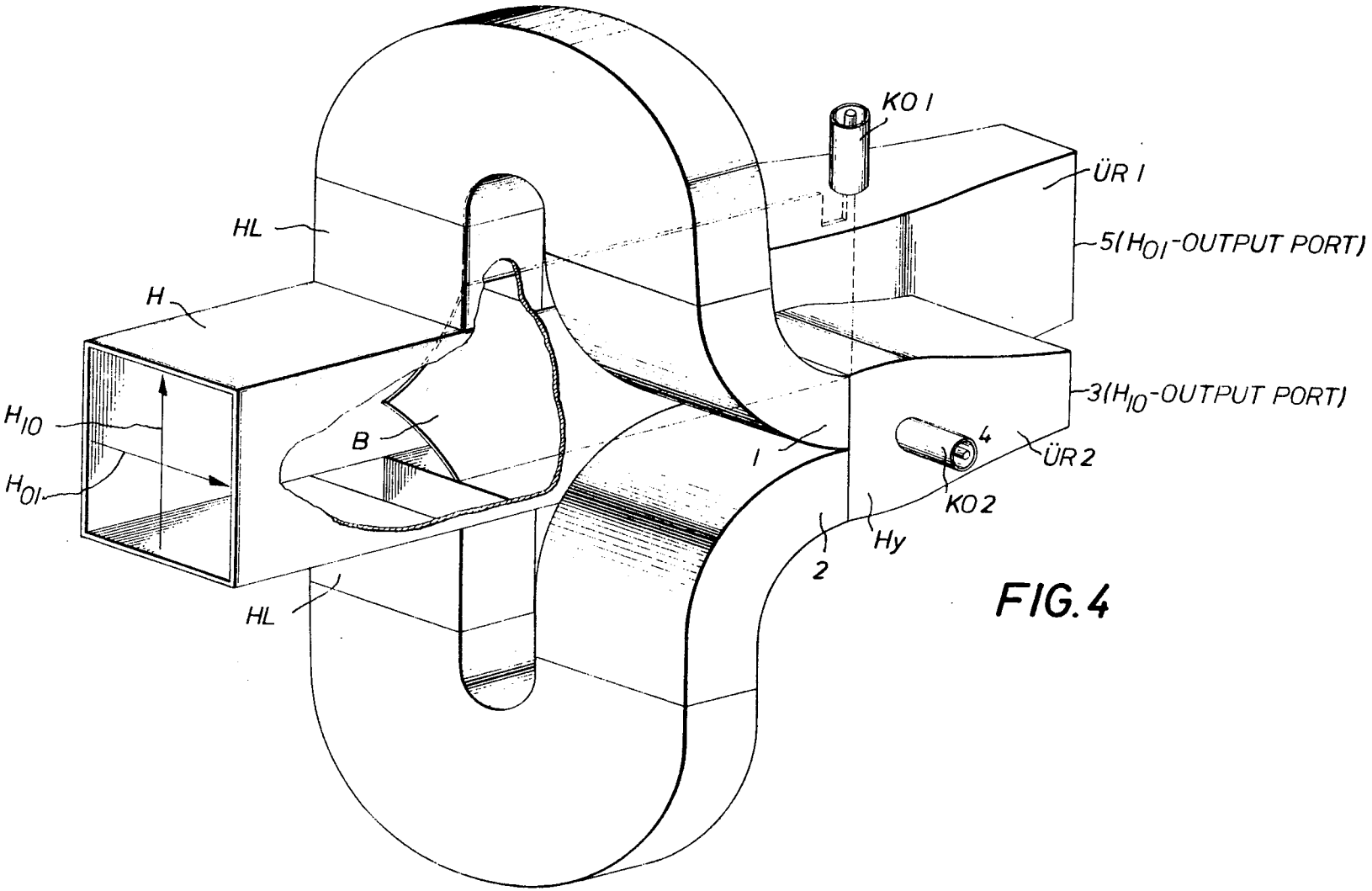

FIG. 4 shows an arrangement of the orthogonal-mode-transducing central portions, i.e., the polarization filter portions, of a system filter with the waveguides HL arranged in the E-position.

DETAILED DESCRIPTION OF THE PREFERRED EMBODIMENTS

Referring now to FIG. 1, there is shown a singly symmetrical polarization filter including a doubly polarizable waveguide section H which is arranged so that its longitudinal axis is perpendicular to the plane of the drawing. The doubly polarizable waveguide H is shown as a square waveguide section but it is to be understood that the waveguide section may also be circular. This waveguide H receives the input signal, e.g. from an antenna, at the end thereof facing the viewer. The waveguide section H is suited for transmission of both polarization directions which in the illustrated embodiment is in the form of the H10 and the H01 modes. The waveguide section H and the connections thereto are shown in greater detail in FIG. *2a.*

As in the classical polarization filters according to German Pat. No. 1,128,491, issued July 5, 1960, one or a plurality of partitions B are provided to axially divide the waveguide section H into two symmetrical waveguides $H_1$ and $H_2$ and produce a short circuit for the H01 mode so that standing waves are produced. This partitioning influences the H10 mode only insignificantly and it can propagate in the form of partial waves along the axially divided waveguide section H. The partition B may be stepped or continuous in its transverse dimensions when seen in the axial direction of the waveguide section H beginning with a given starting width up to the full width of the waveguide section H. The partition B may end either within the waveguide section H as shown in FIG. *2a* or, if desired within a transition section ÜR whose purpose will be explained below.

In contradistinction to the classical polarization filter, the standing H01 wave i.e., the wave polarized parallel to the plane of partition B, is decoupled by means of two symmetrical waveguide windows F formed in the opposite walls of the waveguide section H, with each window F being coupled to a respective rectangular waveguide HL. Each of the decoupling rectangular waveguides HL, and consequently its associated window F, is oriented so that the narrow side of its cross section lies in the plane of the drawing and the longer side extends in the direction of the longitudinal axis of the waveguide section H. The symmetrical arrangement of the decoupler waveguides HL prevents, in broadband operation, excitation of the H11 and the E11 wave on the part of the decoupler waveguides themselves. The supermode operation of the waveguide ($f \leqq 2 \cdot fc$; $fc$ = limit frequency of the H10 wave) is advisable since otherwise it would be difficult to realize broadband matching due to waveguide dispersion. In order to obtain better guidance with less interference in the longitudinal flow of the H10 wave, each of the waveguide windows F may be provided with longitudinal bars B1 which extend parallel to the longer side of the cross section of the waveguide HL. It should be noted that although in the illustrated embodiment the decoupler waveguides HL lie in the H position of the wave to be decoupled from the doubly polarizable waveguide, it is also possible to provide decoupling by an arrangement in which the decoupling waveguides are arranged perpendicularly thereto in the E position.

The two symmetrical waveguide decouplers HL must be brought together again in order to produce a uniform waveguide connection. In order to reduce influences from differing phases, this can be accomplished by means of double T-junctions, i.e., the so-called magic or hybrid tee. For the desired transmission of two signals at frequencies $f1$ and $f2$, for example 11 and 14 GHz, it is impossible, however, to obtain a magic tee with the required electrical quality. For this reason frequency filters are connected in series with the waveguide windows F. In particular, each of the decoupler waveguides HL is connected to one arm or part of a respective three part junction V, e.g. a tee junction, each of whose other arms are connected to a respective bandpass filter BP for passing the lower of the two frequency bands of the decoupled wave, and to a highpass filter HP for passing the higher of the two frequency bands of the decoupled wave. The outputs of the two bandpass filters BP are connected to two symmetrical arms of a magic tee T1 while the outputs of the two highpass filters HP are connected to two symmetrical arms of a magic tee T2. This permits separate combination of the branch line for signals $f1$ and $f2$, respectively, in the magic tees T1 and T2.

The highpass filters HP preferably comprise waveguide sections with a cross section that is tapered or reduced to such an extent that the lower frequency band can no longer propagate. The transitions from the tapered cross section of the filters HP to the normal cross section of the magic tee T2 is effected by means of a transition piece U with continuous changing cross sections.

The useful energy of the two frequency bands is available in the sum arms $\Sigma f1$ and $\Sigma f2$ of the magic tees T1 and T2 respectively. The difference arms $\Delta$ of the magic tees T1 and T2 are terminated by absorbers A.

The orthogonally polarized waves of the signals $\Sigma f1$ and $\Sigma f2$ of the H01 mode, i.e., the waves which were not decoupled, are transmitted to a further filter W2, which is connected in series with the output of the waveguide section H, and are there separated from one another. These signals are of the H10 mode and pass through a transition piece UR, whose cross section tapers from the square cross section of the waveguide section H of the illustrated embodiment to a rectangular cross section, into the filter W2. This filter W2 may be a filter such as described above in connection with the state of the art for the separation of two frequency bands of a wave. The further two signals at frequency $\Sigma f1'$ and $\Sigma f2'$ are separated in the filter W2 from the signal of the H10 mode and are available at the respective outputs of this filter.

Figures 2A, 2B:
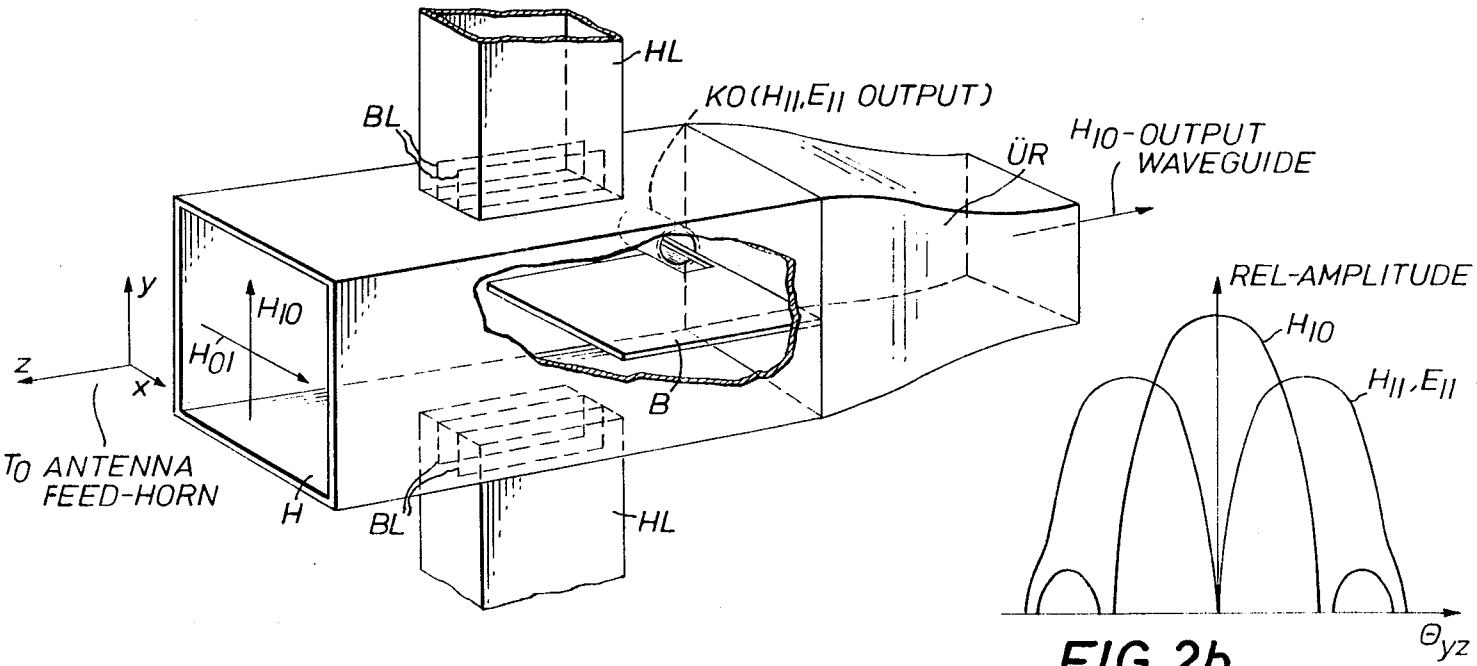

As indicated above, it is desirable for the system filter to provide a signal for correcting the deviation of the antenna connected to the system filter from its desired position. It is known, e.g. see U.S. Pat. No. 3,566,309, issued Feb. 23, 1971, that higher order modes in the antenna feed system may be evaluated as the deviation criterion for the pointing direction of an antenna to a distant transmitter, e.g., a satallite. The provision of the signal for evaluation is accomplished in the illustrated embodiment by means of a lateral tap disposed in the plane of a partition B by a coaxial line connection KO. Such a lateral tap permits decoupling of the H11 and E11 modes from the waveguide section H which, in conjunction with the associated radiation characteristic of the antenna to be fed, constitutes a perfect deviation criterion for the coincidence of the antenna axis with the direction of the station being received. The coaxial line connection KO may be within the waveguide section H as shown in FIG. 2*a* or within the transition section ÜR if as indicated above the partition B extends into the transition section ÜR.

If the boresight-axis of the antenna connected to this waveguide device is moved in the *y-z*-plane, the received $H_{10}$-signal changes according to the antenna's radiation pattern (sum-pattern). If the same is done with the $H_{11}$, $E_{11}$-signal at the coaxial output (KO), a difference pattern is achieved, which is suitable to feed into an antenna-autotrack device operating as an amplitude-monopulse tracking system (FIG. 2*b*).

FIG. 3 shows the central part of the system filter using a doubly polarisable waveguide with circular cross-section. This arrangement as well as that of FIG. 2*a* may be applied to circular polarization using a polarizer(pol) switched between antenna-feed-horn and the system filter. The polarizer (pol) itself contains for example a dielectric plate (P) inclined 45° degrees to the planes of the two polarisations.

A polarization filter arrangement in E-position is shown in FIG. 4. In this case the partition B lies parallel to the electric field of the waveguide mode $H_{10}$ which is now decoupled in the waveguides HL. The partition B is tapered so that the $H_{10}$-mode is transduced into HL with a minimum of reflections.

Both waveguide branches HL feed into the symmetrical arms 1, 2 of a broad-band hybrid T (H*y*). The sum-arm (3) consists of the transition ÜR2 and is associated to the energy of the $H_{10}$-mode of waveguide H. The difference arm (4) of this hybrid is constructed as a coaxial connection (K02). At the output of K02 part of the energy of the $H_{11}$ and $E_{11}$-modes is available.

The energy of the $H_{01}$-mode is transduced axially through the waveguide H to the output 5 via transition ÜR1. The partition B is connected to the coaxial port K01. K01 makes also available part of the $H_{11}$, $E_{11}$-energy of waveguide H. The arrangement of FIG. 4 needs only one hybrid T due to the fact that a broad band-device is applied, while the arrangement of FIG. 1 needs two narrow band hybrid T's with the two diplexers in between the hybrids and the waveguides HL.

It will be understood that the above description of the present invention is susceptible to various modidications, changes and adaptations, and the same are intended to be comprehended within the meaning and range of equivalents of the appended claims.

What is claimed is:

1. A system filter for separating signals of two different frequency bands with each frequency band being doubly orthogonally polarized whereby the same frequency can be used in two channels, said system filter comprising in combination:

a broadband polarization filter of singly symmetrical construction including a doubly polarizable waveguide section, partition means positioned within said waveguide for axially dividing said waveguide section into two symmetrical partial waveguides, and means for coupling out the two frequency bands of the wave which is polarized parallel to the plane of said partition means including two coupling windows each formed in a respective one of a pair of oppositely disposed walls of said doubly polarizable waveguide section and at least one waveguide hybrid tee having two symmetrical arms coupled to said coupling windows;

diplexer means coupled to said at least one waveguide hybrid tee for separation of the two frequency bands of the wave which is polarized parallel to the plane of said partition means; and, means for dividing the other orthoganally polarized wave into its two frequency bands including frequency filters connected in series with said doubly polarizable waveguide section via a transition section connected to the output of said doubly polarizable waveguide section.

2. A system filter as defined in claim 1 wherein: each of said arms of each of said waveguide tees is coupled to its associated coupling window via a respective section of rectangular waveguide with the longer side of the rectangular cross section extending along the longitudinal axis of said doubly polarizable waveguide section; and each of said coupling windows is provided with at least one longitudinal bar which extends parallel to said longer side of the rectangular waveguide.

3. A system filter as defined in claim 1 wherein: said polarization filter includes waveguides associated to said symmetrically arranged coupling windows which lie in the E-plate of the coupled $H_{10}$-mode and are connected to the symmetrical arms of a broadband hybrid T whereby one polarization is associated to the sum arm of said hybrid T and the difference arm is associated to the $H_{11}$, $E_{11}$-modes and the $H_{01}$-mode propagates along said symmetrically divided central waveguide section to the output of said waveguide transition, while said partition means is connected to a coaxial output, which makes available part of the energy of the $H_{11}$ and $E_{11}$-modes.

4. A system filter as defined in claim 1 wherein a coaxial decoupling means is disposed in the plane of said partition means for coupling out higher order modes, whereby the decoupled signals may be used for correcting deviations of the axis of an antenna connected to said system filter from its rated direction.

5. A system filter as defined in claim 1 wherein said doubly polarizable waveguide section is designed so that its cross section permits propagation of the fundamental mode as well as the next higher modes.

6. A system filter as defined in claim 1 wherein said doubly polarizable waveguide section has a square cross section.

7. A system filter as defined in claim 1 wherein said doubly polarizable waveguide section has a circular cross section.

8. A system filter as defined in claim 1 further comprising a polarization converter connected in series with the input of said doubly polarizable waveguide section to convert orthogonally circularly polarized waves to orthogonally linearly polarized waves.

9. A system filter as defined in claim 1 wherein said partition means is varied in its transverse dimensions when seen in axial direction beginning with a given starting width up to the full waveguide width.

10. A system filter as defined in claim 1 wherein: there are first and second of said waveguide hybrid tees each having two symmetrical arms which are each coupled to a respective one of said coupling windows; said symmetrical arms of said waveguide hybrid tees are coupled to said coupling windows via said diplexer means; and said diplexer means includes first and second three port waveguide junctions each having one port connected to a respective one of said coupling windows, first and second highpass filters for passing the higher of said two frequency bands with each of said highpass filters being connected between a second port of a respective one of said waveguide junctions and a respective one of the two symmetrical arms of said first hybrid tee so that said higher of said two frequency bands is available at the sum arm of said first hybrid tee, and first and second bandpass filters for passing the lower of said two frequency bands with each of said bandpass filters being connected between the third port of a respective one of said waveguide junctions and a respective one of the two symmetrical arms of said second hybrid tee so that said lower of said two frequency bands is available at the sum arm of said second hybrid tee.

11. A system filter as defined in claim 10 wherein said one port of each of said three port waveguide junctions is coupled to its associated coupling window via a respective section of rectangular waveguide with the longer side of the rectangular cross section extending along the longitudinal axis of said doubly polarizable waveguide section; and each of said coupling windows is provided with at least one longitudinal bar which extends parallel to said longer side of the rectangular waveguide.

12. A system filter as defined in claim 10 wherein the differential outputs of each of said hybrid tees is terminated by an absorber.

13. A system filter as defined in claim 10 wherein each of said highpass filters comprises a waveguide with a cross section which is dimensioned so that said lower of said two frequency bands is unable to propagate.

14. A system filter as defined in claim 13 wherein each said high-pass filter with the reduced cross section is connected with said first hybrid tee, which has a standard cross section, via a continuous transition piece.

* * * * *